US006129422A

United States Patent [19]

Siddle et al.

[11] Patent Number: 6,129,422

[45] Date of Patent: Oct. 10, 2000

[54] CUTTING TOOL HOLDER RETENTION SYSTEM

[75] Inventors: David R. Siddle, Greensburg; Ted R. Massa, Latrobe; John S. VanKirk, Export, all of Pa.

[73] Assignee: Kennametal Inc., Latrobe, Pa.

[21] Appl. No.: 09/224,035

[22] Filed: Dec. 31, 1998

[51] Int. Cl.[7] ..... E21C 35/193

[52] U.S. Cl. ..... 299/102; 299/79.1

[58] Field of Search ..... 403/157, 161; 299/79.1, 102, 103, 106, 108

[56] References Cited

U.S. PATENT DOCUMENTS

| | | |
|---|---|---|
| 3,749,449 | 7/1973 | Krekeler . |
| 4,275,929 | 6/1981 | Krekeler . |
| 4,621,871 | 11/1986 | Salani . |
| 4,650,254 | 3/1987 | Wechner . |
| 5,011,229 | 4/1991 | O'Neill et al. . |
| 5,040,850 | 8/1991 | Komotzki . |
| 5,067,775 | 11/1991 | D'Angelo . |
| 5,607,206 | 3/1997 | Siddle et al. . |
| 5,769,505 | 6/1998 | Siddle et al. . |
| 5,833,323 | 11/1998 | Massa et al. . |

FOREIGN PATENT DOCUMENTS

| | | |
|---|---|---|
| 3131478 A1 | 2/1983 | Germany . |
| 874913 | 10/1981 | U.S.S.R. . |
| 2223045 | 3/1990 | United Kingdom . |

*Primary Examiner*—Eileen D. Lillis
*Assistant Examiner*—John Kreck
*Attorney, Agent, or Firm*—John J Prizzi

[57] ABSTRACT

An excavation cutting tool holder retention system. The cutting tool holder retention system includes a cutting tool holder having a holder side surface, a flange recess at least partially enclosed by the holder side surface, and a holder engagement surface together with a support block having a tool holder bore into which the cutting tool holder is inserted and a block pin bore intersecting the tool holder bore, the block pin bore defining a block engagement surface which is inclined downwardly relative to the tool holder bore. The cutting tool holder retention system further includes a pin having a pin shaft, the pin shaft having a pin flange which engages the flange recess so as to limit translational movement of the pin shaft. The pin engages the block engagement surface and the holder engagement surface such that the pin may be moved to draw the cutting tool holder into the tool holder bore.

27 Claims, 3 Drawing Sheets

CUTTING TOOL HOLDER RETENTION SYSTEM

TECHNICAL FIELD

This invention relates to excavation cutting tools, and more particularly to a retention system for retaining an excavation cutting tool holder in a support block during use.

BACKGROUND ART

Excavation cutting tool assemblies for such applications as continuous mining or road milling typically comprise a cutting tool, sometimes referred to as a cutting bit, rotatably mounted within a support block. The support block in turn is mounted onto a drum or other body, typically by welding, which in turn is driven by a suitable power means. When a number of such support blocks carrying cutting tools are mounted onto a drum, and the drum is driven, the cutting tools will engage and break up the material which is sought to be mined or removed. The general operation of such a mining or construction machine is well known in the art.

Because the support block is exposed, it is subject to wear and abuse and must be cut or torched off the drum and replaced when unusable. In order to prolong the life of the support block, a cutting tool holder, sometimes referred to as a cutting tool sleeve, bit holder, or bit sleeve, is sometimes employed. The cutting tool is rotatably or otherwise releasably mounted within the bit holder which in turn is mounted within the support block via some mechanical connection. This helps to protect the support block from abuse and wear, thus minimizing or eliminating the down time periods otherwise required for drum repair. The use of such bit holders is well known in the art. For example, U.S. Pat. No. 5,067,775 to D'Angelo discloses the use of such a bit holder which is referred to as a sleeve in that patent.

It is well known that such cutting tools and cutting tool holders are subjected to considerable stresses during mining or other operations. Accordingly, it is desirable that the cutting tool holder be mounted to the support block in such a manner as to minimize movement of the cutting bit holder in order to maximize the life of the cutting tool. It is also important that the mounting between the cutting tool holder and the support block be resistant to vibratory loosening which could likewise lead to premature cutting tool wear and failure. Various methods have been proposed or used in the past to mount a cutting tool sleeve within a support block in an attempt to minimize cutting tool holder movement or loosening, while maximizing cutting tool life.

For example, U.S. Pat. No. 3,749,449 to Krekeler discloses a support block having two upstanding members or bifurcations which define therebetween a channel into which fits a tool holder. A pin passes through the support block and the cutting tool holder and releasably secures the tool holder to the support block. The Krekeler patent relies on cooperation between the bottom surface of the cutting tool holder and an upper surface of the support block, at the bottom of the channel, to resist forces tending to pivot the cutting tool holder about the pin. In other words, the Krekeler patent relies upon a close tolerance fit to minimize rotational movement of the cutting tool and cutting tool holder about the pin during use. Otherwise, movement of the cutting tool holder in the support block will cause unnecessary wear to the cutting tool, the cutting tool holder, and the support block.

As another example, U.S. Pat. No. 4,650,254 to Wechner discloses the use of two bolts to connect a cutting tool holder to a block. The two bolts pass horizontally through the rear surface of the support block and through the shank portion of the cutting tool holder. Such a connection may be subject to vibratory loosening.

As yet another example, U.S. Pat. No. 5,607,206 to Siddle et al. discloses a cutting tool holder which is inserted into the tool holder bore of a support block. The cutting tool holder has a holder engagement surface, which may be a conically shaped bore. A pin having a pin engagement surface, which may be conically shaped, is movably mounted to the support block such that the pin engagement surface may be moved to engage the holder engagement surface and draw the cutting tool holder into the tool holder bore of the support block

SUMMARY OF THE INVENTION

An object of the present invention is to provide an improved excavation cutting tool holder retention system which allows a cutting tool holder to be securely fastened to a support block.

In carrying out the above objects, and other objects and features of the present invention, an improved excavation cutting tool holder retention system is provided. The improved excavation cutting tool holder retention system comprises a cutting tool holder having a holder side surface, a flange recess at least partially enclosed by the holder side surface, and a holder engagement surface. The system also includes a support block having a tool holder bore into which the cutting tool holder is inserted and a block pin bore intersecting the tool holder bore, the block pin bore defining a block engagement surface which is inclined downwardly relative to the tool holder bore. The system further includes a pin having a pin shaft, the pin shaft having a pin flange, the pin flange engaging the flange recess so as to limit translational movement of the pin shaft. The pin engages the block engagement surface and the holder engagement surface such that the pin may be moved to draw the cutting tool holder into the tool holder bore.

The pin may have a holder engagement portion and a block engagement portion, the block engagement portion engaging the block engagement surface and the holder engagement portion engaging the holder engagement surface.

Furthermore, the pin may have an aligned cylindrical portion which engages the holder engagement surface and an angled cylindrical portion which engages the block engagement surface. In such an embodiment, one of the block pin bore and angled cylindrical portion may have a male mating feature and the other of the block pin bore and angled cylindrical portion may have a female mating feature such that the angled cylindrical portion will not rotate within the block pin bore.

In all of these embodiments, the holder engagement surface may be defined by a transverse pin recess.

In such case, in a more specific embodiment, the support block has block pin bores which define the block engagement surface and are inclined downwardly. The pin runs through and engages the transverse pin recess of the cutting tool holder. The pin has a pin shaft, a first jam member, and a second jam member, the first and second jam members each having a block engagement portion which moveably engages the block pin bores. The pin shaft also has a pin flange which engages the flange recess so as to limit translational movement of the pin shaft relative to the transverse pin recess. At least one of the first and second jam members is moveable along the pin shaft relative to the other of the first and second jam members such that the block engagement portion of the first and second jam members is moved along the block pin bores and the cutting tool holder is drawn into the tool holder bore.

The pin shaft may have a threaded portion and one of the first and second jam members may have a threaded jam bore such that one of the first and second jam members may threadably engage the pin shaft and be moved relative to the other of the first and second jam members. This may be facilitated by a pin shaft having a first pitch threaded portion and a second pitch threaded portion, the first jam member having a first threaded jam bore such that the first jam member threadably engages the first pitch threaded portion of the pin shaft, and the second jam member having a second threaded jam bore such that the second jam member threadably engages the second pitch threaded portion of the pin shaft.

In each of these embodiments, the block pin bores and the first and second jam members may be configured such that the first and second jam members will not rotate within the block pin bore.

Furthermore, in these embodiments, the block pin bores and the transverse pin recess may be cylindrical. The first jam member may have a first aligned cylindrical portion and a first angled cylindrical portion and the second jam member may have a second aligned cylindrical portion and a second angled cylindrical portion such that the first and second aligned cylindrical portions engage the transverse pin recess of the cutting tool holder and the first and second angled cylindrical portions define the block engagement portion and engage the block pin bores.

In each of these embodiments, one of the block pin bores and the first and second angled cylindrical portions may define a male mating feature and the other of the block pin bores of the first and second angled cylindrical portions may define a female mating feature such that the first and second angled cylindrical portions will not rotate within the block pin bores. The male mating feature may be a semi-cylindrical projection and the female mating feature may be a semi-cylindrical groove.

In another more specific embodiment, the cutting tool holder has a holder slot intersecting the transverse pin recess such that the cutting tool holder may be removed from the tool holder bore of the support block by moving the second jam member relative to the first jam member such that the first and second jam members do not interfere with the transverse pin recess and the cutting tool holder may be withdrawn from the tool holder bore while the first and second jam members still engage the block pin bores.

In a more specific embodiment applicable to all preceding embodiments, the tool holder has a holder shoulder and the support block has a seating shoulder region adjacent the tool holder bore. When the cutting tool holder is drawn into the tool holder bore as described, the holder shoulder will abut the seating shoulder region.

In another specific embodiment applicable to all preceding embodiments, the pin shaft has a pin shaft axis and a pin shaft diameter and the pin flange is a cylindrical portion about the pin shaft axis, the cylindrical portion having a cylindrical portion diameter greater than the pin shaft diameter. In another specific embodiment applicable to all preceding embodiments, the flange recess is a pin flange slot.

All of these embodiments would encompass and include a more specific embodiment in which the flange recess is totally enclosed by the holder side surface of the cutting tool holder.

The present invention also includes an improved cutting tool holder for use with a support block and pin, the support block having a tool holder bore into which the cutting tool holder is inserted and block pin bores inclined downwardly, the pin having a pin shaft, a first jam member, and a second jam member moveable along the pin shaft relative to the first jam member, the pin shaft having a pin flange, and the first and second jam members moveably engaging the block pin bores. The improved cutting tool holder comprises an outer wear region and a shank portion, the shank portion having a shank portion side surface and a transverse pin recess which is substantially aligned with the block pin bores when the shank portion is inserted into the tool holder bore such that the pin can run between the block pin bores through the transverse pin recess. The shank portion also has a flange recess at least partially enclosed by the shank portion side surface which engages the pin flange so as to limit translational movement of the pin shaft relative to the transverse pin recess. The first and second jam members engage the block pin bores and the transverse pin recess such that moving the second jam member relative to the first jam member will draw the shank portion into the tool holder bore of the support block.

In a more specific embodiment, the shank portion of the cutting tool holder has a holder slot such that the shank portion may be removed from the tool holder bore of the support block by moving the second jam member relative to the first jam member such that the first and second jam members no longer interfere with the transverse pin recess and the shank portion may be withdrawn from the tool holder bore such that the first and second jam members still engage the block pin bores.

In another more specific embodiment, the flange recess is a pin flange slot. The pin flange slot may be oriented substantially perpendicular to the axis of the transverse pin recess.

In yet another more specific embodiment, the flange recess is totally enclosed by the shank portion side surface.

The advantages resulting from this invention are numerous. Because the flange recess or pin flange slot is at least partially enclosed by the holder side surface or shank portion side surface, the cutting tool holder is stronger and more resistant to deformation.

As another example, by having the block pin bores inclined downwardly, the cutting tool holder will be drawn into an especially tight relationship with the tool holder bore. This tight fit is especially secure if one or both of the shank portion or tool holder bore is tapered so that the shank portion of the cutting tool is wedged into the tool holder bore when the components are engaged by utilizing the pin. The security of the fit is also increased if the tool holder has a holder shoulder which abuts a seating shoulder region of the support block when the cutting tool holder is drawn into the tool holder bore.

Another advantage of this present invention is that the tool holder bore of the support block may have a configuration so as to completely surround and provide multi-directional support to the cutting tool holder.

As a further advantage, when the tool holder is worn, it is easily removed and changed by simply loosening the pin.

Furthermore, because the pin flange resides within the flange recess of the cutting tool holder during use, translational movement of the pin shaft is limited. As a result, binding of the first and second jam members will be reduced or prevented and the jam members will be kept at approximately the same distance from the center of the pin during loosening so to help ensure easy removal of the cutting tool holder.

Further objects and advantages of this invention will be apparent from the following description, reference being had to the accompanying drawings wherein preferred embodiments of the present invention are clearly shown.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

BEST MODE FOR CARRYING OUT THE INVENTION

Figure 1:
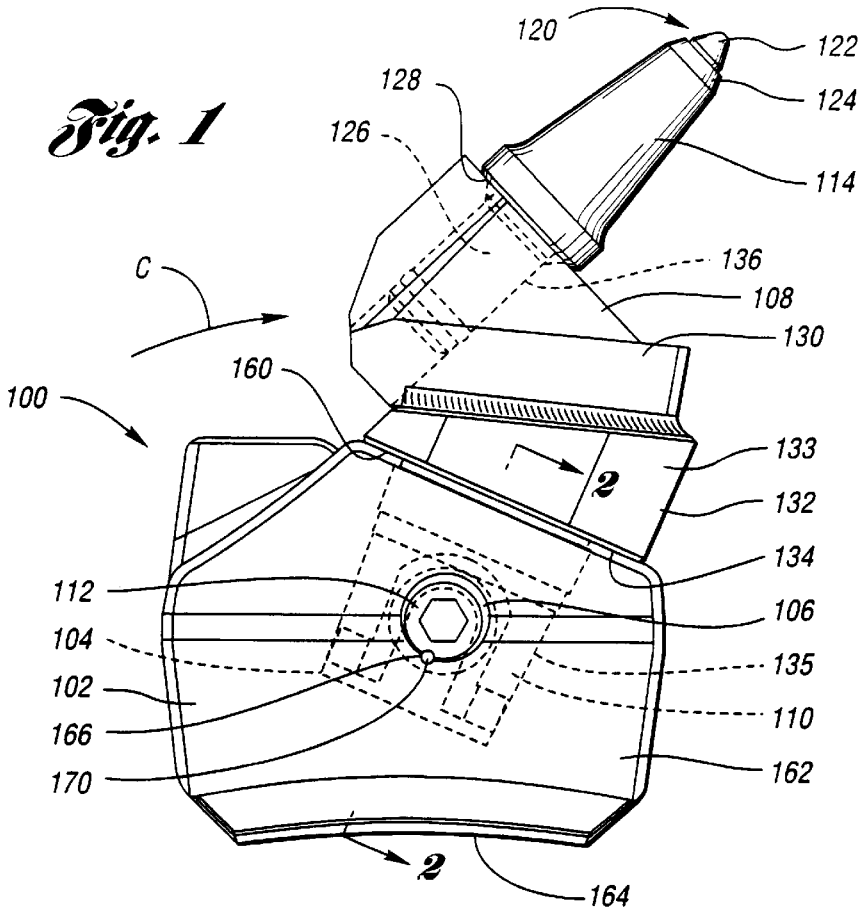
FIG. 1 is a side view of a support block, cutting tool holder, and cutting tool showing one embodiment of the invention.
Figure 2:
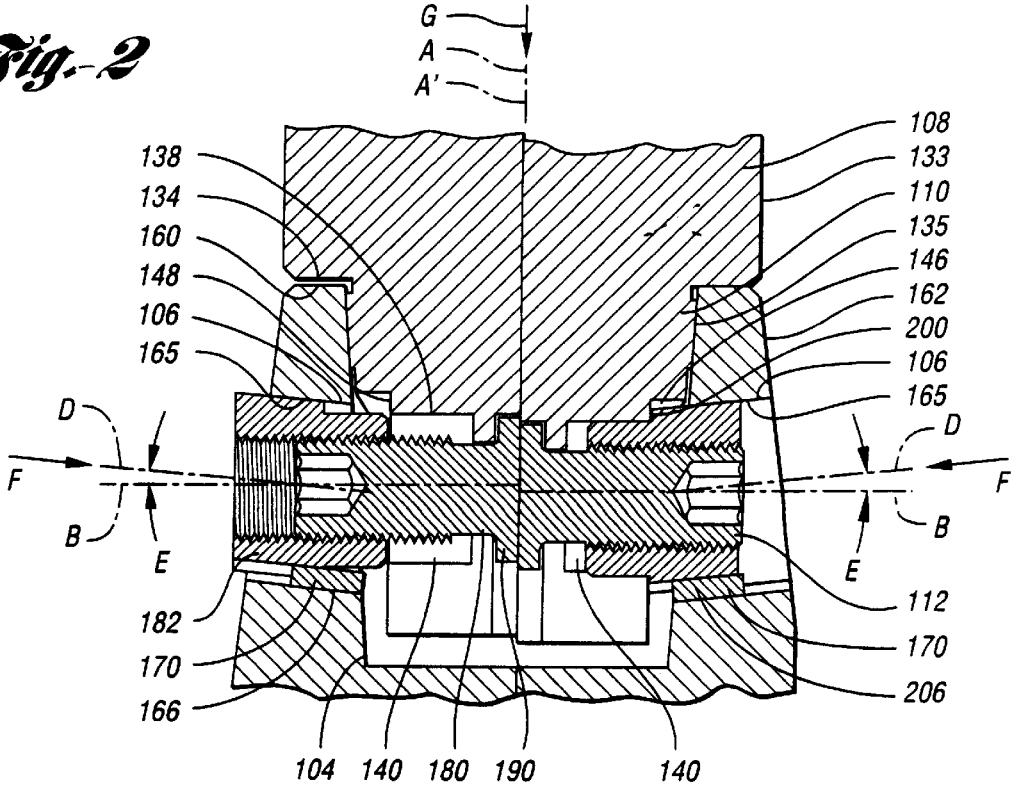
FIG. 2 is a sectional view taken along the plane indicated by line 2—2 in FIG. 1, the left half showing the invention in the loose condition and the right half showing the tightened condition.

One embodiment of the cutting tool holder retention system 100 is shown in FIGS. 1 and 2. The cutting tool retention system 100 includes a support block 102 having a tool holder bore 104 and block pin bores 106 and a cutting tool holder 108 having a holder shank portion 110 mated to the support block 102 via a pin 112. In the embodiment shown, a cutting tool 114 may be rotatably and releasably mounted within the cutting tool holder 108. However, the scope of this invention would cover cutting tool holder retention systems in which the cutting tool is non-rotatably mounted.

In use, such support blocks 102 can be distributed over and fastened to, such as by welding, the circumference and length of a drum or other body (not shown) according to any desired pattern. The drum or other body may be driven by any conventional and suitable power means to cause the cutting tools 114 to engage and break up material that they are applied to. Such applications are well known in the art, and will not be described further here.

The cutting tool 114 typically has an elongated body. The cutting end 120 of the cutting tool 114 typically comprises a hard cutting insert 122 mounted onto a generally conical outer region 124. This hard cutting insert 122 may be made from cemented tungsten carbide or any other suitable material. The hard cutting insert 122 is generally mounted at the end of the conical outer region 124 where the cutting insert 122 may be brazed or otherwise suitably fastened into place. The cutting tool 114 also includes a tool shank 126 adjoining a shoulder 128 of the conical outer region 124. Because such cutting tools are generally known in the art, they need not be described in further detail here.

Cutting tool holders may have a variety of configurations. As shown in FIGS. 1–5, the cutting tool holder 108 shown in this embodiment has a holder block portion 130 connected to a holder pedestal portion 132. The holder block portion 130 and pedestal portion 132 may be connected in any suitable manner, such as by welding. The cutting tool holder 108 also has a holder side surface 133 defined in this embodiment by side surfaces of the holder block portion 130 and the pedestal portion 132. In this embodiment, the pedestal portion 132 defines the shank portion 110 of the cutting tool holder 108 and a holder shoulder 134. The shank portion 110 also defines a shank side surface 135.

The holder block portion 130 of the cutting tool holder 108 defines a tool bore 136 in which the cutting tool 114 may be rotatably or otherwise mounted. Such rotatable or non-rotatable mountings are well known in the art, and will not be described in further detail here.

Figure 3:
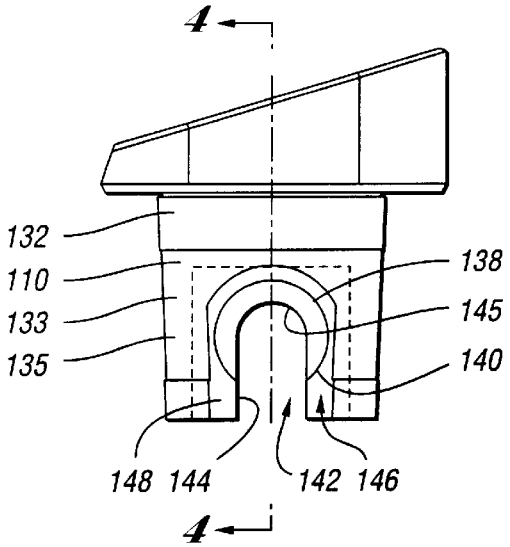
FIG. 3 is a side view of the shank portion of the cutting tool holder showing the holder slot.

While the shank portion 110 of the cutting tool holder 108 may have a variety of configurations, the shank portion 110 as shown in this embodiment is tapered along a center axis "A". As best shown in FIG. 3, the shank portion 110 also has a holder engagement recess which in this embodiment comprises transverse pin recesses 138. The transverse pin recesses 138 in this embodiment are cylindrical and are aligned along a center axis designated "B" which preferably intersects the center axis "A" of the shank portion 110. The holder engagement recess has a holder engagement surface 140 which in the embodiment shown is the surface defined by the transverse pin recesses 138, especially the lower surface when locking the tool holder 108 and the upper surface when releasing the tool holder 108.

Figure 4:
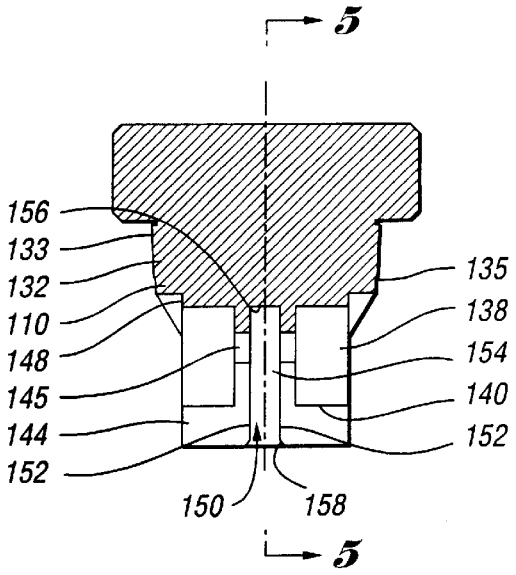
FIG. 4 is a sectional view taken along the plane indicated by line 4—4 in FIG. 3.
Figure 5:
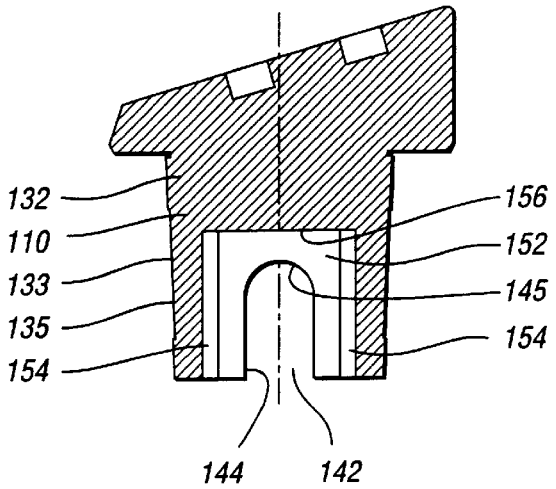
FIG. 5 is a sectional view taken along the plane indicated by line 5—5 in FIG. 4.
Figure 6:
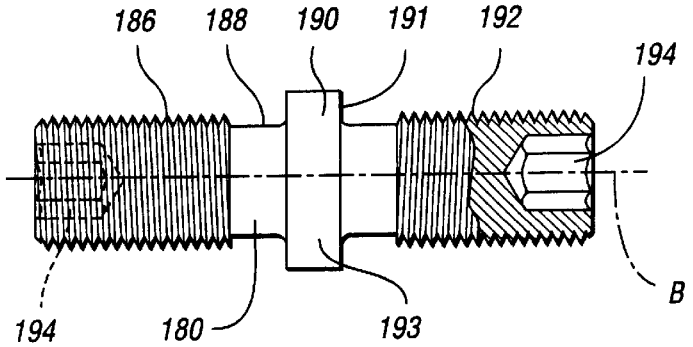
FIG. 6 is a side view of a threaded pin with the right half partially broken away.

As best shown in FIGS. 3–5, the holder shank portion 110 defines a holder slot 142 which intersects the transverse pin recesses 138. In this embodiment, the holder slot 142 is defined by two vertical slot sides 144 and a top semi-cylindrical surface 145 aligned along the center axis "B.". As best shown in FIGS. 2, 3 and 4, at the end of each transverse pin recess 138 the holder shank 110 also defines jam recesses 146 having vertical recess walls 148.

Figure 9:
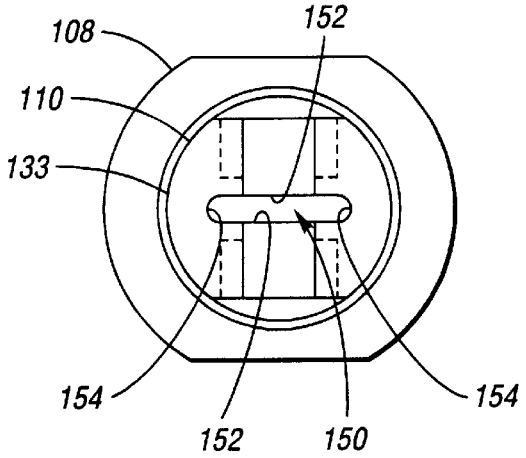
FIG. 9 is a bottom view of the cutting tool holder.

As best shown in FIGS. 4, 5 and 9, the holder shank 110 also defines a pin flange recess which in this embodiment is a pin flange slot 150. The pin flange slot 150 in this embodiment is defined by two vertical slot sides 152, two semi-cylindrical slot ends 154 and an upper slot wall 156. In this embodiment, the vertical slot sides 152 are oriented substantially perpendicular to the axis "B" of the transverse pin recesses 138 and the holder slot 142. The two vertical slot sides 152 have chamfers 158 at the lower end of the holder shank portion 110. Also, in this embodiment, the pin flange slot 150 is enclosed by the holder side surface 133, in this case the shank side surface 135.

As shown in FIGS. 1 and 2, the tool holder bore 104 of the support block 102 may be partially surrounded but is more typically fully surrounded by a seating shoulder region 160. The tool holder bore 104 of this embodiment has a holder bore center axis "A'" which coincides with the axis "A" of the shank portion 110 of the cutting tool holder 108 when the components are assembled as shown. The tool holder bore 104 in this preferred embodiment is tapered so as to match the taper of the shank portion 110 of the cutting tool holder 108. It has been found that a suitable total included taper angle be approximately 5° 45'.

The support block 102 also has a side surface 162 and a base 164 which may be mounted to a drum or other body (not shown) by way of welding or any other suitable method. As shown in this embodiment, the support block base 164 has a radius of curvature such that the base 164 will seat solidly on a cylindrical drum.

The tool holder bore 104, and accordingly the cutting tool holder 108 and the cutting tool 114, is typically pitched in the direction of travel of the cutting tool 114, designated as direction "C" in FIG. 1.

Furthermore, the support block 102 has the block pin bores 106, which are cylindrical and aligned along block pin bore axes designated "D." As shown in FIG. 2, the block pin bore axes "D" intersect the axis "B" of the transverse pin recess 138 at an angle "E."

The block pin bores 106 have a block engagement surface 165, which in the embodiment shown is the surface defined by the block pin bores 106, especially the upper surface when locking the tool holder 108 and the lower surface when releasing the tool holder 108. As shown in FIG. 2, the block engagement surface 165, and in this embodiment the block pin bores 106 having axes "D," are inclined downwardly relative to the tool holder bore 104.

As best shown in FIGS. 1 and 2, the block pin bores 106 also define pin bore grooves 166 along the lower surface of the pin bores 106. The pin bore grooves 166 in this embodiment are semi-cylindrical in shape. Mating pins 170 having a cylindrical configuration reside within the pin bore grooves 166. The mating pins 170 may be press fit into the pin bore grooves 166 in which case the pin bore grooves 166 will have a cross section configuration slightly greater than a half circle or may be held in position using any suitable fastening method such as by tack welding or epoxy adhesives. The mating pins 170 may be made of any suitable material, such as 52100 steel.

As shown in FIGS. 2, 6, 7, and 8, the pin 112 includes a pin shaft 180 having a pin shaft diameter, a first jam member 182 and a second jam member 184 which are assembled along the center axis "B." The pin shaft 180 in this embodiment has a first pitch threaded portion 186, an unthreaded portion 188 including a pin flange 190 having pin flange sides 191, and a second pitch threaded portion 192. While the pin flange 190 is required in this embodiment, the pin shaft need not have an unthreaded portion. The pin flange 190 may have any suitable configuration as long as it has a greater diameter than the pin shaft 180 and will fit within the pin flange slot 150 of the holder shank 110. In the embodiment shown, the pin flange 190 is a cylindrical portion 193 about the pin shaft axis "B" and the cylindrical portion 193 has a cylindrical portion diameter greater than the pin shaft diameter. Furthermore, in the embodiment shown, the dimension between the pin flange sides 191 should be less than the dimension between the vertical slot sides 152 such that the pin shaft 180 may be rotated within the retention system 100 as will be explained.

While the first pitch threaded portion 186 is shown as being a right hand threaded portion and the second pitch threaded portion 192 is shown as being a left hand threaded portion, that need not be the case. While the threads may be made in any suitable manner, the first and second pitch threaded portions 186 and 192 may be cold rolled. The pin shaft 180 also has an engagement structure 194 which, in the embodiment shown, constitutes hexagonal recesses centered along the axis "B" of the pin shaft 180.

Figure 7:
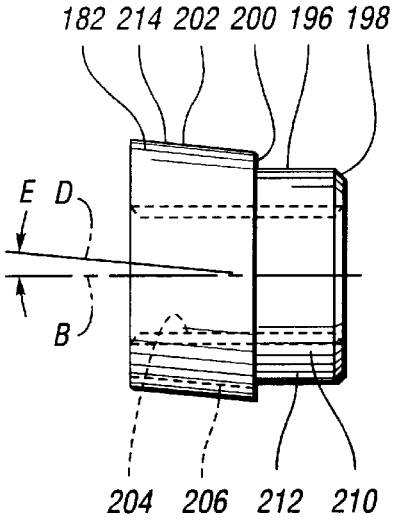
FIG. 7 is a side view of a first jam member.

As shown in FIG. 7, the first jam member 182 has an aligned cylindrical portion 196 aligned along the axis "B," the outer end of which has a chamfer 198, preferably at an angle of 45° to the axis "B." Adjoining the aligned cylindrical portion 196 at a jam shoulder 200 is an angled cylindrical portion 202 having a center axis "D" set at an angle "E" to the axis "B."

The first jam member 182 also defines a threaded jam bore 204 which, in the embodiment shown, constitutes a right hand threaded bore manufactured to threadably engage the first pitch threaded portion 186 of the pin shaft 180.

The first jam member 182 also defines a mating groove 206 along the lower surface of the angled cylindrical portion 202. In this embodiment, the mating groove 206 has a semi-cylindrical configuration designed to mate with the mating pin 170 as will be explained in further detail.

The pin 112 has a pin engagement surface 210. In the embodiment shown, the pin engagement surface 210 has a holder engagement portion 212 and a block engagement portion 214. In this embodiment, the holder engagement portion 212 is the outer surface, especially the lower surface when locking and upper surface when releasing, of the aligned cylindrical portion 196. The block engagement portion 214 is the outer surface, especially the upper surface when locking and the lower surface when releasing, of the angled cylindrical portion 202.

Figure 8:
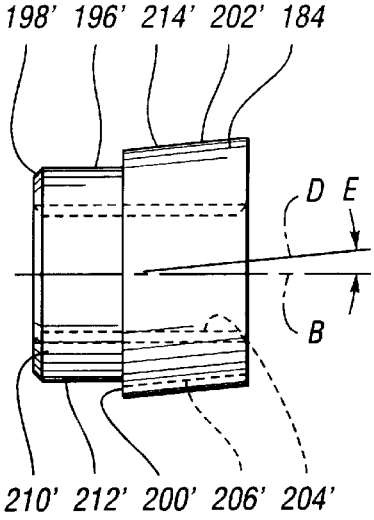
FIG. 8 is a side view of a second jam member.

As shown in FIG. 8, the second jam member 184 is a mirror image duplicate of the first jam member 182. Like the first jam member 182, the second jam member 184 has an aligned cylindrical portion 196', a chamfer 198', a jam shoulder 200', an angled cylindrical portion 202', and a threaded jam bore 204' which in the embodiment shown has a left hand thread manufactured to threadably engage the second pitch threaded portion 192 of the pin shaft 180. Like the first jam member 182, the second jam member 184 also has a pin engagement surface 210' including a holder engagement portion 212' and a block engagement portion 214'. Also similar to the first jam member 182, the angled cylindrical portion 202' of the second jam member 184 has an axis "D" set at an angle "E" to the center axis "B" of the aligned cylindrical portion 196'.

Like the threaded shaft 180, while the first jam member 182 may have a right hand threaded jam bore 204 and the second jam member 184 may have a left hand threaded jam bore 204', that need not be the case.

To use the embodiment of this invention shown in FIGS. 1–8, the first or second jam member, 182 or 184, is partially threaded onto the first or second pitch threaded portion respectively, 186 or 192, of the pin shaft 180. The pin shaft 180, together with the one first or second jam member 182 or 184, is then inserted through the block pin bores 106 such that the mating groove 206 or 206' of the first or second jam member, 182 or 184, is aligned roughly with the mating pin 170 of one of the block pin bores 106.

The other of the second or first jam member, 184 or 182, is then threaded onto the other of the second or first pitch threaded portion, 192 or 186, of the pin shaft 180 until the mating groove 206' or 206 of the second or first jam member, 184 or 182, is roughly aligned with the mating pin 170 of the other one of the block pin bores 106.

An appropriate tool may then be used to engage the engagement structure 194 of the pin shaft 180 and rotate the pin shaft 180 appropriately such that the first and second jam members, 182 and 184, will be drawn towards each other. At the same time, the first and second jam members 182 and 184 must be maintained in position until the mating grooves 206 and 206' engage the mating pins 170. As shown on the left half of FIG. 2, the pin shaft 180 may be rotated until the angled cylindrical portion 202 and 202' of the first and second jam members, 182 and 184, reside partially within the block pin bores 106.

The holder shank portion 110 of the cutting tool holder 108 may then be inserted into the tool holder bore 104 of the support block 102 with an orientation such that the pin shaft 180 will slide into the holder slot 142 and such that the pin flange 190 will slide into the pin flange slot 150.

At this point, and as shown on the left half of FIG. 2, the holder shank portion 110 of the cutting tool holder 108 will be loosely fitted within the tool holder bore 104 of the support block 102. Furthermore, at this point the pin flange 190 will reside within the pin flange slot 150 such that translational movement, such as lateral movement of the pin 112 along the axis "B," will be limited by the dimensional tolerances between the pin flange 190 and the pin flange slot 150.

An appropriate tool may then again be used to engage the engagement structure 194 of the pin shaft 180 and rotate the pin shaft 180 appropriately such that the first and second jam members, 182 and 184, will be drawn towards each other. As the first and second jam members, 182 and 184, are drawn towards each other, the aligned cylindrical portions 196 and 196' of the jam members, 182 and 184, will be forced into the transverse pin recesses 138 aided by the chamfers 198 and 198' on the ends of the jam members. At the same time, the rotation of the pin shaft 180 will cause the block engagement portions 214 and 214' of the pin engagement surfaces 210 and 210' of the angled cylindrical portions 202 and 202' to travel along and engage the block engagement surface 165 of the block pin bores 106 such that the jam members will move in the direction marked "F," as shown in FIG. 2. The pin flange 190 within the pin flange slot 150 will limit translational movement, such as lateral movement of the pin 112 along the axis "B," such that the pin 112 will be maintained in a relatively centered relationship relative to axis "A" and such that binding of the first and second jam members 182 and 184 within the block pin bores 106 and the transverse pin recesses 138 will be reduced or prevented.

At the same time, the holder engagement portions 212 and 212' of the pin engagement surfaces 210 and 210' of the jam members, 182 and 184, will engage the holder engagement surface 140 of the transverse pin recesses 138 of the cutting tool holder shank portion 110 thereby forcibly wedging the cutting tool holder shank portion 110 of the cutting tool holder 108 in the direction marked "G," as shown in FIG. 2, into a tight fitting relationship with the tool holder bore 104 of the support block 102 until the holder shoulder 134 abuts the seating shoulder region 160 as shown on the right half of FIG. 2. As shown on the right half of FIG. 2, the jam shoulder 200 may then protrude into the jam recess 146 of the cutting tool holder shank portion 110.

The cutting tool holder retention system 100 shown in FIGS. 1–7 should work satisfactorily when the transverse pin recesses 138 of the cutting tool holder shank portion 110 have a diameter of 1.000" to 1.001", the holder slot 142 has a dimension of 0.625" between the vertical recess walls 144, the pin flange slot 150 has a dimension of 0.250" to 0.255" between the vertical slot sides 152, the block pin bores 106 have a diameter of 1.124" to 1.125" set at an angle "E" between 5°±10' and 8°±10', the aligned cylindrical portion 196 and 196' of the jam members 182 and 184 has a diameter of 0.998" to 0.999", the angled cylindrical portion 202 and 202' of the jam members has a diameter of 1.122" to 1.123" and is set at an angle between 5°±10' and 8°±10' so as to match the angle of the block pin bores 106, and the threaded jam bore 204 and 204' constitutes a 37/64" through hole, tapped to 5/8"-24 thread, right or left handed as required, the pin flange 190 has a dimension of 0.230" to 0.240" between the pin flange sides 191, and the unthreaded portion 188 of the pin shaft 180 has a diameter of 0.54" while the first and second pitch threaded portions 186 and 192 are 5/8"-24 thread, left or right handed as required. All of the components may be made from any appropriate grade of steel, such as grade 4140 steel, 38-43 HRC.

Nylok® manufactured by Nylok Fastener Corporation, or any other suitable material or adhesive, may be employed to help prevent the pin shaft 180 from rotating during use and to help prevent the first and second jam members, 182 and 184, from loosening.

When it is desired to change the cutting tool holder 108, the pin shaft 180 is simply rotated in the opposite direction via the engagement structure 194 until the cutting tool holder shank portion 110 can be removed from the tool holder bore 104 and the pin shaft 180 via the holder slot 142. As shown on the left half of FIG. 2, the first and second jam members, 182 and 184, need not be removed from the pin shaft 180, and the mating grooves 206 and 206' need not be disengaged from the mating pins 170, for the cutting tool holder 108 to be removed.

Figure 10:
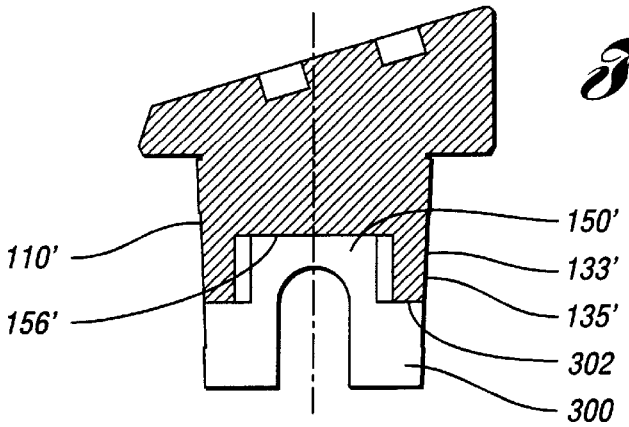
FIG. 10 is a sectional view of a shank portion of a cutting tool holder showing an alternative embodiment of this invention.

FIG. 10 is a sectional view of a shank portion 110' of a cutting tool holder 108' showing an alternative embodiment of this invention. This section is identical to the section shown in FIG. 5 except that in this embodiment the pin flange recess, in this embodiment the slot 150', is only partially enclosed by the holder side surface 133', in this case the shank side surface 135'. More specifically, in this embodiment, the intersecting slot portion 300 having an upper intersecting slot wall 302, intersects the holder side surface 133', in this case the shank side surface 135'. In this embodiment, the pin flange recess, in this embodiment the slot 150', is partially enclosed by the holder side surface 133', in this case the shank side surface 135', because the uppermost surface of the pin flange, the upper slot wall 156', is higher than the uppermost surface of the intersecting slot portion 300, in this embodiment the upper intersecting slot wall 302. In other words, a portion of the pin flange slot 150' is enclosed by the holder side surface 133', in this case the shank side surface 135'.

An advantage of all of the embodiments shown is that the flange recess, in these embodiments the pin flange slot 150 or 150', is at least partially enclosed by the holder side surface 133 or 133', in these embodiments the shank side surface 135 or 135'. Accordingly, the cutting tool holder 108, and in these embodiments the shank portion 110 or 110', is stronger, and more resistant to deformation.

Another advantage of these embodiments is that the matching cylindrical surfaces of the transverse pin recesses 138 and the aligned cylindrical portions 196 and 196' of the jam members, 182 and 184, together with the matching cylindrical surfaces of the block pin bores 106, and the corresponding angled cylindrical portions 202 and 202' of the jam members, will provide a better contacting relationship between the engagement surfaces, thereby lowering contact stresses. Furthermore, because the pin flange 190 resides during use within the flange recess, the pin flange slot 150, translational movement, such as lateral movement of the pin shaft 180 along the axis "B," is limited. As a result, binding of the first and second jam members 182 and 184 within the block pin bores 106 will be reduced or prevented as previously noted and the jam members 182 and 184 will be kept at approximately the same distance from the axis "A" during loosening of the retention system 100 so as to help ensure easy removal of the cutting tool holder 108.

Additionally, because the pin shaft 180 moves in the direction "G" as the cutting tool holder retention system 100 is tightened, a locking action is provided to restrain the system and help prevent undesired loosening. Similarly, during unlocking, the pin translates forward in a direction reverse of "G," providing a "bump off" motion to the cutting tool holder 108 for easier disengagement. Yet another advantage is that the holder slot 142 in the cutting tool holder shank portion 110 allows the cutting tool holder 108 to be changed without the removal of any pins or screws from the support block 102.

All patents and patent applications cited herein are hereby incorporated by reference in their entirety.

While particular embodiments of the invention have been illustrated and described, it will be obvious to those skilled in the art that various changes and modifications may be made without departing from this invention. It is intended that the following claims cover all such modifications and all equivalents that fall within the spirit of this invention.

What is claimed is:

1. An excavation cutting tool holder retention system comprising:

a cutting tool holder having a holder side surface, a flange recess at least partially enclosed by the holder side surface, and a holder engagement surface;

a support block having a tool holder bore into which the cutting tool holder is inserted and a block pin bore intersecting the tool holder bore, the block pin bore defining a block engagement surface which is inclined downwardly relative to the tool holder bore; and a pin having a pin shaft, the pin shaft having a pin flange, the pin flange engaging the flange recess so as to limit translational movement of the pin shaft, the pin engaging the block engagement surface and the holder engagement surface such that the pin may be moved to draw the cutting tool holder into the tool holder bore.

2. The excavation cutting tool holder retention system of claim 1 wherein the pin has a holder engagement portion and a block engagement portion, the block engagement portion engaging the block engagement surface and the holder engagement portion engaging the holder engagement surface.

3. The excavation cutting tool holder retention system of claim 1 wherein the pin has an aligned cylindrical portion which engages the holder engagement surface and an angled cylindrical portion which engages the block engagement surface.

4. The excavation cutting tool holder retention system of claim 3 wherein one of the block pin bore and angled cylindrical portion has a male mating feature and the other of the block pin bore and angled cylindrical portion has a female mating feature such that the angled cylindrical portion will not rotate within the block pin bore.

5. The excavation cutting tool holder retention system of claim 1 wherein the holder engagement surface is defined by a transverse pin recess.

6. The excavation cutting tool holder retention system of claim 1 wherein the support block has a seating shoulder region and the cutting tool holder has a holder shoulder such that the seating shoulder region will abut the holder shoulder when the pin is moved to draw the cutting tool holder into the tool holder bore.

7. The excavation cutting tool holder retention system of claim 1 wherein the flange recess is totally enclosed by the holder side surface.

8. An excavation cutting tool holder retention system comprising:

a cutting tool holder having a holder side surface, a transverse pin recess, and a flange recess at least partially enclosed by the holder side surface;

a support block having a tool holder bore into which the cutting tool holder is inserted and block pin bores intersecting the tool holder bore, the block pin bores being inclined downwardly relative to the tool holder bore; and a pin running through and engaging the transverse pin recess of the cutting tool holder, the pin having a pin shaft, a first jam member, and a second jam member, the pin shaft having a pin flange which engages the flange recess so as to limit translational movement of the pin shaft relative to the transverse pin recess, the first and second jam members each having a block engagement portion which moveably engages the block pin bores, at least one of the first and second jam members being moveable along the pin shaft relative to the other of the first and second jam members such that the block engagement portion of the first and second jam members is moved along the block pin bores and the cutting tool holder is drawn into the tool holder bore.

9. The excavation cutting tool holder retention system of claim 8 wherein the pin shaft has a threaded portion and one of the first and second jam members has a threaded jam bore such that one of the first and second jam members may threadably engage the pin shaft and be moveable relative to the other of the first and second jam members by rotating the pin shaft.

10. The excavation cutting tool holder retention system of claim 8 wherein the pin shaft has a first pitch threaded portion and a second pitch threaded portion, the first jam member has a first threaded jam bore such that the first jam member threadably engages the first pitch threaded portion of the pin shaft and the second jam member has a second threaded jam bore such that the second jam member threadably engages the second pitch threaded portion of the pin shaft such that the first and second jam members may be moveable along the pin shaft relative to the other of the first and second jam members by rotating the pin shaft.

11. The excavation cutting tool holder retention system of claim 8 wherein the block pin bores and the first and second jam members are configured such that the first and second jam members will not rotate within the block pin bores.

12. The excavation cutting tool holder retention system of claim 8 wherein the block pin bores and the transverse pin recess are cylindrical, the first jam member has a first aligned cylindrical portion and a first angled cylindrical portion, and the second jam member has a second aligned cylindrical portion and a second angled cylindrical portion, the first and second aligned cylindrical portions engaging the transverse pin recess of the cutting tool holder and the first and second angled cylindrical portions defining the block engagement portion and engaging the block pin bores.

13. The excavation cutting tool holder retention system of claim 12 wherein one of the block pin bores and the first and second angled cylindrical portions define a male mating feature and the other of the block pin bores and the first and second angled cylindrical portions define a female mating feature such that the first and second angled cylindrical portions will not rotate within the block pin bores.

14. The excavation cutting tool holder retention system of claim 13 wherein the male mating feature is a semi-cylindrical projection and the female mating feature is a semi-cylindrical groove.

15. The excavation cutting tool holder retention system of claim 14 wherein the cutting tool holder has a holder slot intersecting the transverse pin recess such that the cutting tool holder may be removed from the tool holder bore of the support block by moving the second jam member relative to the first jam member such that the first aligned cylindrical portion and the second aligned cylindrical portion no longer interfere with the transverse pin recess and the cutting tool holder may be withdrawn from the tool holder bore while the first and second angled cylindrical portions still engage the block pin bores.

16. The excavation cutting tool holder retention system of claim 8 wherein the cutting tool holder has a holder slot intersecting the transverse pin recess such that the cutting tool holder may be removed from the tool holder bore of the support block by moving the second jam member relative to the first jam member such that the first and second jam members do not interfere with the transverse pin recess and the cutting tool holder may be withdrawn from the tool holder bore while the first and second jam members will still moveably engage the block pin bores.

17. The excavation cutting tool holder retention system of claim 8 wherein the support block has a seating shoulder region and the cutting tool holder has a holder shoulder such that the seating shoulder region will abut the holder shoulder when the cutting tool holder is drawn into the tool bore.

18. The excavation cutting tool holder retention system of claim 8 wherein the flange recess is totally enclosed by the holder side surface.

19. The excavation cutting tool holder retention system of claim 8 wherein the pin shaft has a pin shaft axis and a pin shaft diameter and the pin flange is a cylindrical portion about the pin shaft axis, the cylindrical portion having a cylindrical portion diameter greater than the pin shaft diameter.

20. The excavation cutting tool holder retention system of claim 19 wherein the flange recess is a pin flange slot.

21. The excavation cutting tool holder retention system of claim 20 wherein the pin flange slot is totally enclosed by the holder side surface.

22. A cutting tool holder for use with a support block and pin, the support block having a tool holder bore into which the cutting tool holder is inserted and block pin bores inclined downwardly, the pin having a pin shaft, a first jam member, and a second jam member moveable along the pin shaft relative to the first jam member, the pin shaft having a pin flange, the first and second jam members moveably engaging the block pin bores, the cutting tool holder comprising:

an outer wear region and a shank portion, the shank portion having a shank portion side surface and a transverse pin recess which is substantially aligned with the block pin bores when the shank portion is inserted into the tool holder bore such that the pin can run between the block pin bores through the transverse pin recess, the shank portion having a flange recess at least partially enclosed by the shank portion side surface, the flange recess engaging the pin flange so as to limit translational movement of the pin shaft relative to the transverse pin recess, the first and second jam members engaging the block pin bores and the transverse pin recess such that moving the second jam member relative to the first jam member will draw the shank portion into the tool holder bore of the support block.

23. The cutting tool holder of claim 22 wherein the flange recess is totally enclosed by the shank portion side surface.

24. The cutting tool holder of claim 22 wherein the shank portion has a holder slot such that the shank portion may be removed from the tool holder bore of the support block by moving the second jam member relative to the first jam member such that the first and second jam members no longer interfere with the transverse pin recess and the shank portion may be withdrawn from the tool holder bore such that the first and second jam members still engage the block pin bores.

25. The cutting tool holder of claim 22 wherein the flange recess is a pin flange slot.

26. The cutting tool holder of claim 25 wherein the transverse pin recess has a transverse pin recess axis and the pin flange slot is oriented substantially perpendicular to the transverse pin recess axis.

27. The cutting tool holder of claim 25 wherein the pin flange slot is totally enclosed by the shank portion side surface.

* * * * *